United States Patent [19]

Snider

[11] Patent Number: 4,846,280

[45] Date of Patent: Jul. 11, 1989

[54] DRILL STEM TEST METHOD AND APPARATUS

[75] Inventor: Philip M. Snider, Anchorage, Ak.

[73] Assignee: Marathon Oil Company, Findlay, Ohio

[21] Appl. No.: 179,163

[22] Filed: Apr. 8, 1988

[51] Int. Cl.[4] ..... E21B 34/06

[52] U.S. Cl. ..... 166/372; 166/386; 166/319; 166/332

[58] Field of Search ..... 166/372, 374, 386, 250, 166/252, 310, 319, 332

[56] References Cited

U.S. PATENT DOCUMENTS

| | | | |
|---|---|---|---|
| 2,092,337 | 9/1937 | Spencer | 166/1 |
| 2,330,509 | 9/1943 | McCullough | 166/1 |
| 2,601,122 | 6/1952 | McKinley | 166/1 |
| 2,687,176 | 8/1954 | Jones | 166/74 |
| 2,946,565 | 7/1960 | Williams | 255/1.8 |
| 3,295,615 | 1/1967 | Brieger et al. | 175/4.52 |
| 3,384,170 | 5/1968 | van Poollen | 166/3 |
| 3,823,773 | 7/1974 | Nutter | 166/250 |
| 3,981,360 | 9/1976 | Marathe | 166/319 |
| 4,141,418 | 2/1979 | Nutter | 166/324 |
| 4,258,793 | 3/1981 | McGraw et al. | 166/374 |
| 4,434,854 | 3/1984 | Vann et al. | 166/319 |
| 4,509,604 | 4/1985 | Upchurch | 175/4.52 |
| 4,541,481 | 9/1985 | Lancaster | 166/65.1 |
| 4,593,771 | 6/1986 | Comeau | 175/48 |
| 4,605,069 | 8/1986 | McClalfin et al. | 166/310 |
| 4,669,537 | 6/1987 | Rumbaugh | 166/332 |
| 4,726,420 | 2/1988 | Weeks | 166/372 |

FOREIGN PATENT DOCUMENTS

| | | | |
|---|---|---|---|
| 1002532 | 3/1983 | U.S.S.R. | 166/372 |
| 1049658 | 10/1983 | U.S.S.R. | 166/250 |

OTHER PUBLICATIONS

Scott, Robert W., "How New Inflatable Packer Drill-stem Tester Works", *World Oil*, Oct. 1966, pp. 129–132.

Scott, Robert W., "21 New Developments in Production", *World Oil*, Feb. 1967, pp. 53–60.

Clayton, W. P., Fisk, R. R., and Farley, D. L., "Field Experience With Full-Opening Drill Stem Testing Tools for Floating Rigs", North Holland Publishing Co., 1976, pp. 397–405.

Edwards, Arnold G., Clayton, Wilbur P., and Brigham, Merrit G., "New Equipment Permits Perforating, Testing, Treating and Re-Testing With One Trip in the Hole", European Offshore Petroleum Conference and Exhibition, London, Oct. 24–27, 1978, pp. 321–326.

Lukey, J. B., "A Practical Drill Stem Testing Technique, Combining High Shot Density Underbalanced Perforating With Full Bore Test Tools", Paper No. 84-35-118, 35th Annual Technical Meeting of the Petroleum Soc. of CIM, Calgary, Jun, 10–13, 1984, pp. 379–391.

*Primary Examiner*—Jerome W. Massie
*Assistant Examiner*—Terry Lee Melius
*Attorney, Agent, or Firm*—Jack L. Hummel

[57] ABSTRACT

Means for lifting formation fluid to the surface in a drill stem test. The drill string has first openings allowing entry of formation fluid and upwardly spaced second openings which are normally closed by a sleeve slidably mounted on the drill string. Fluid pressure from within the drill string impinges on a transverse surface of the sleeve and forces it down, allowing treatment fluid to enter the drill string from the annulus between the drill string and the well bore. A jet pump comprised of a flow constriction creating a venturi effect causes treatment fluid to accelerate upwardly in the drill string, the circulation of the treatment fluid drawing the formation fluid to the surface. The second openings covered by the sleeve include the fluid crossover of the jet pump. A standing valve in the drill string between the first and second openings allows down hole shut-in and pressure build-up tests.

9 Claims, 2 Drawing Sheets

DRILL STEM TEST METHOD AND APPARATUS

FIELD OF THE INVENTION

This invention relates to a drill stem test method and to the apparatus used in carrying out the method. More particularly, it relates to a method and apparatus for conducting a drill stem test where the formation fluid is not under sufficient reservoir or solution gas pressure to cause it to flow to the surface without assistance.

BACKGROUND OF THE INVENTION

In the process of drilling a fluid producing well, such as an oil well, it is common to determine the nature of a zone or formation of interest before completion of the well by conducting a drill stem test. It is important in such a test to obtain fluid samples as well as to determine other significant factors such as the permeability of the formation and the volume and pressure of the reservoir. To obtain a more complete profile of the well and the surrounding formation, the pressure build-up under down hole shut-in conditions is also usually measured after conducting the drill stem test.

To conduct a drill stem test, the test equipment or tool string is normally assembled on a drill string which is lowered into the bore. A packer in the drill string is seated at a predetermined depth and functions to seal off the hole below it A perforating gun on the tool extending below the packer is actuated to produce perforations in the well bore to allow fluid from the surrounding formation to flow into the bore. Fluid enters the tool below the packer and flows up the drill string. Suitable instruments in the tool string record the pressure of the fluid.

If the fluid is under enough pressure to naturally flow to the surface the drill stem test can be routinely handled. If, however, there is insufficient reservoir pressure or solution gas, or a combination of the two, to cause the fluid to flow naturally to the surface, it is desirable to lift the fluid by some other means. This normally requires the drill string to make separate trips down the bore, one to perforate the casing and another to test the fluid, or it can require multi-trip wire line runs in the well. Also, by testing the well on separate trips from the perforation operation, testing on later runs requires the well to be killed. These multiple trips with wire line or drill string add significantly to the cost of the well, since each trip is quite expensive.

It would be advantageous in a drill stem test involving formation fluid which is under insufficient pressure to naturally flow to the surface, to be able to lift or convey the formation fluid to the surface in the same trip of the drill string used for the purpose of perforating the well casing. I would also be advantageous to be able to do so without interfering with or preventing a down hole shut-in pressure test.

SUMMARY OF THE INVENTION

This invention employs a drill string having a first opening through which formation fluid can flow into the drill string below a packer. A second opening is created in the drill string at a location above the packer and treatment fluid is caused to flow through the second opening and upwardly therefrom. The rate of flow of the treatment fluid is then increased near the second opening by a substantial amount such that the upward flow of the treatment fluid draws the formation fluid upwardly therewith.

In practice, the drill string would first be inserted into a fluid well bore and would be seated with a conventional packer that seals the well bore. Openings or perforations in the side wall of the well bore are then created below the packer, and formation fluid flows into the drill string through the first opening.

A preferred method for creating the second opening comprises providing an opening in the drill string which is initially covered by movable means subsequently moved out of the way to expose the opening. Preferably the movable means is in the form of a sleeve which is slidably mounted on the drill string and which includes a generally transverse surface. When the transverse surface is exposed to fluid from within the drill string under pressure greater than annular pressure, the force of the fluid pressure on the sleeve is translated into linear movement of the sleeve to a location no longer covering the second opening. Treatment fluid can then pass through the second opening and be accelerated upwardly to draw the formation fluid along with it to the surface.

The preferred means for accelerating the flow of the treatment fluid is a structural arrangement within the drill stem comprising a constricted flow path, commonly known as a jet pump, which creates a venturi effect. In practice, the second opening would comprise the fluid crossover of the jet pump as well as openings in the drill stem adjacent the fluid crossover, with the movable sleeve initially covering the fluid crossover. Because there are no moving parts the fluid can be reliably accelerated.

A standing valve provided in the drill string between the first and second openings permits a down hole shut-in test to be conducted utilizing the same drill string. It also prevents flow into the formation of fluid introduced into the sleeve, thereby permitting the fluid to be maintained under sufficient pressure to cause movement of the sleeve.

Other features and aspects of the invention, as well as other benefits of the invention, will readily be ascertained from the more detailed description of the invention which follows.

DESCRIPTION OF THE PREFERRED EMBODIMENT

Figure 1:
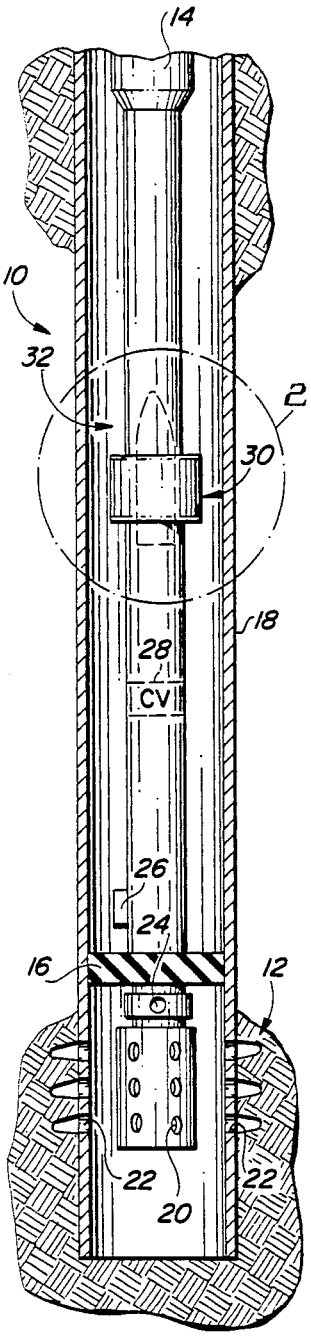
FIG. 1 is a schematic partial longitudinal sectional view of a portion of a fluid well containing the lower portion of a drill string positioned for a drill stem test.

Referring to FIG. 1, a portion of a well bore 10 is shown extending through a formation or zone 12 which is desired to be tested. It is to be understood that the well structure and the drill string may include the usual type of equipment and apparatus extending from the portion shown to the surface, and that the equipment at the well head may take the form of any arrangement found satisfactory to the operation.

A drill string or tubing 4 is shown extending through a packer 16 of the usual type which is capable of supporting a portion of the weight of the drill string and which also provides a seal between the well bore below it and the annulus between the drill string 14 and well casing 18 above it. At the bottom of the drill string are mounted a number of perforating guns 20 of any commonly available type capable of perforating the well casing and surrounding formation as indicated at 22. Immediately above the guns 20 are openings or apertures 24 in the drill string which are designed to be operative prior to or at the time of the creation of the perforations 22. Any desired method of creating openings 24 in the drill string may be employed, such as, for example, by opening a suitable underbalance valve when the perforating guns 20 are fired or by lowering the drill string with the holes open and subsequently forcing out collected fluid by pressurized nitrogen. Since these and other suitable methods for providing holes through which formation fluid may flow into the drill string are well known in the art and since the present invention does not depend on the use of any particular method of providing the openings, further details on the openings 24 are not necessary.

A pressure gauge carrier 26 is mounted on the drill string at a location above the packer 16 and contains pressure gauges for measuring pressures in a manner well known in the art. Located in the drill string upwardly from the packer is a standing valve 28, the construction of which is not shown in any detail because such valves are well known in the art and because the present invention does not require the use of any particular type of standing valve. Pressure gauges can also be attached to the standing valve, if desired, or to the jet pump, described in more detail hereinafter.

Still referring to FIG. 1, located above the standing valve 28 are second openings in the drill string 14 which are covered by a sleeve 30, and inside the openings is a jet pump 32 which comprises a venturi-type arrangement for accelerating the flow of fluid therethrough. The second openings and the sleeve 30 comprise a sleeve valve, the details of which are explained more fully below.

Figure 2:
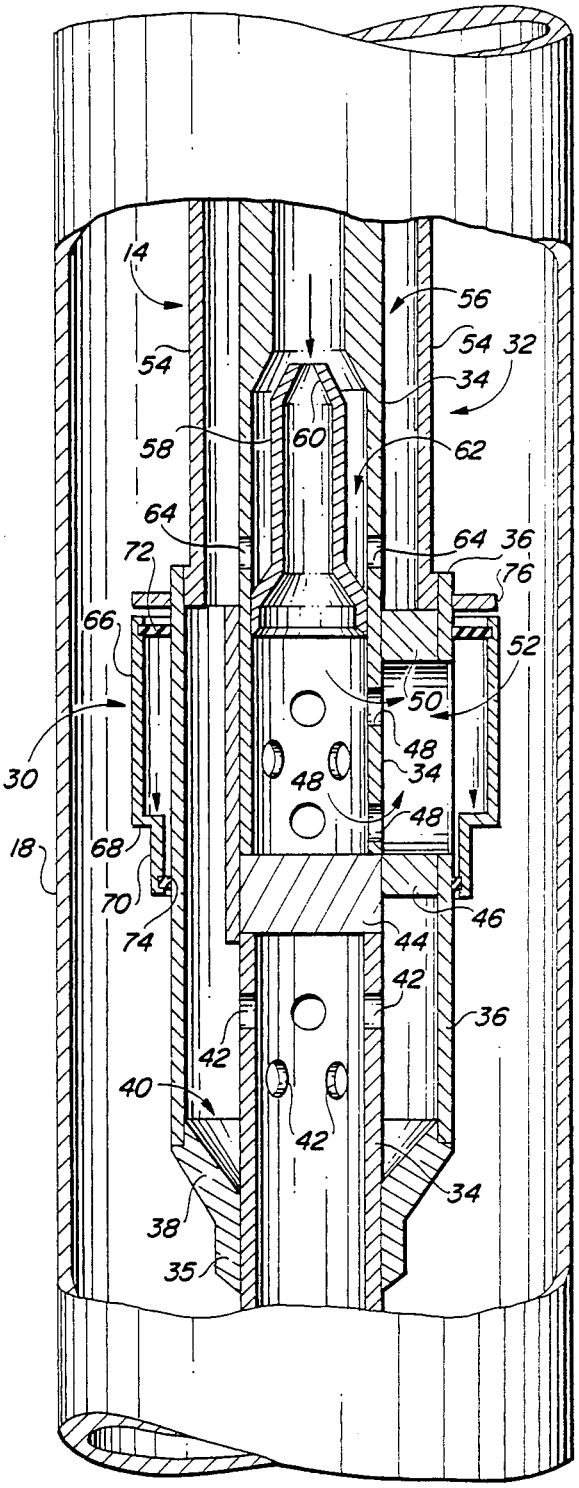
FIG. 2 is an enlarged partial sectional view of the drill string, sowing in more detail the sleeve which initially covers the openings therein and the venturi arrangement for accelerating fluid flow.

Referring now to FIG. 2, which illustrates in more detail the sleeve valve and jet pump arrangement referred to in the preceding paragraph, the drill string and jet pump assembly comprises an inner tube 34 located inside a larger diameter concentric tube 35. A still larger sleeve 36 is connected to tube 35 by connector sleeve 38 at a location above the standing valve. The annulus between the tubes 34 and 36 is indicated at 40 and is connected to the interior of the tube 34 by holes 42, which permit formation fluid to flow up through the drill string tube 34, out the holes 42, and into the annulus 40.

The tube 34 is blocked above the holes 42 by a cap or plug 44. Extending radially inwardly to the plug 44 on the right side of the drawing is a lateral extension 46 of the tube 36 which closes off a portion of the annulus 40. The annulus 40 at the left side of the drawing is unobstructed, however, and formation fluid is free to flow through it. Above the plug 44 the tube 34 contains holes 48, and above the uppermost holes 48 is a lateral extension 50 which extends radially inwardly to the tube 34 from the tube 36 on the right side of the drawing. The tube 36 has a cut-out portion or opening 52 which functions as the fluid crossover in the jet pump. Above the lateral extension 50 the tube 36 is connected to upwardly extending tube section 54 to form an annulus 56 between the tubes 34 and 54.

Connected to the tube 34 at the extension 50 is an upwardly extending tube 58 of reduced diameter having a constricted throat portion terminating in a small diameter nozzle 60. The tube 58 is concentrically located within the tube 34 so that the space between the tubes defines an annulus or flow path 62 which converges toward the outlet of the nozzle 60. Holes 64 in the tube 34 just above the base of the nozzle tube 58 permit fluid to flow from the annulus 40 into the flow path 62. Fluids flowing upwardly through the nozzle 60 and the flow path 62 are thus able to blend together and continue to flow upwardly through the tube 34.

Figure 3:
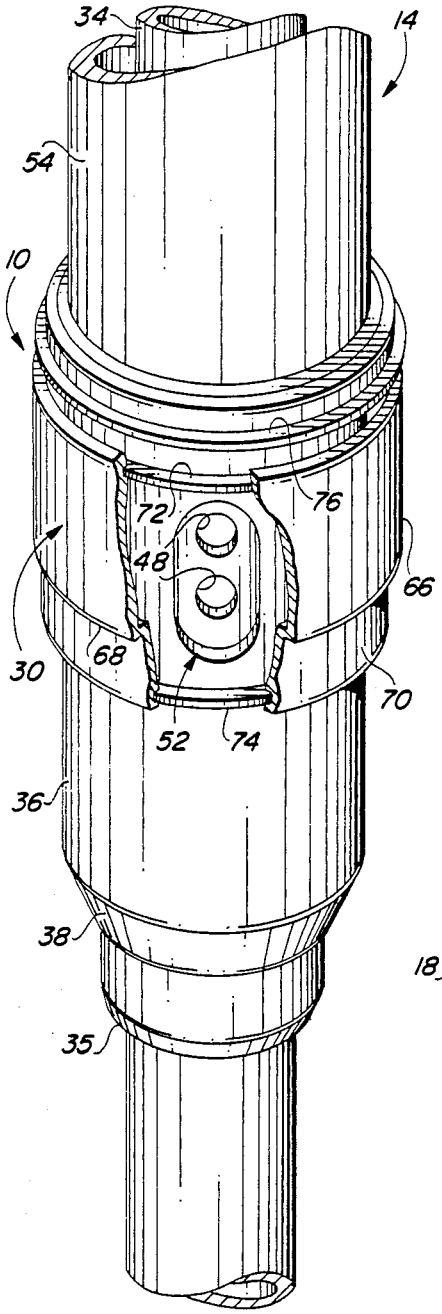
FIG. 3 is a partial pictorial view of the drill string, showing the sleeve in position to cover the fluid crossover.

As shown in FIGS. 2 and 3, the sleeve 30 surrounds the tube 36 to initially close the fluid crossover 52. The sleeve 30 comprises a relatively large diameter sleeve portion 66 connected at its bottom edge by a transverse shoulder or ledge portion 68 to the top edge of a relatively small diameter sleeve portion 70. An annular seal 72 connects the large diameter sleeve portion 66 to the drill string at a point above the jet pump fluid crossover 52, while a smaller diameter annular seal 74 connects the small diameter sleeve portion 70 to the drill string at a point below the jet pump fluid crossover. A stop member 76, which may take the form of an annular flange as shown, or any other suitable form such as protruding lugs, is located just above the sleeve to prevent upward movement of the sleeve.

In operation, the drill string is lowered into position with the packer 16, with the sleeve 30 in place as shown in FIGS. 2 and 3, so that the fluid crossover 52 leading to the openings 48 in the tube 34 is covered. The perforating guns 20 are then actuated to produce the perforations 22, resulting in the flow of formation fluid into the well bore, through the openings 24, and into the drill string 14. Although formation fluid may be under enough pressure to flow up through the tube 34 and out the openings 42, assuming that the pressure of the formation fluid is inadequate to cause the fluid to flow naturally to the surface, it is necessary to assist the flow by other means. This is done by introducing fluid into the drill string so that it flows down through the nozzle 60, out the openings 48 and into the interior of the sleeve 30. Because the standing valve 28 prevents further downward flow of the introduced fluid, the pressure of the fluid can readily produce enough force on the shoulder or ledge 68 to slide the sleeve 32 down to uncover the jet pump fluid crossover 52. As mentioned above, the stop 76 prevents upward movement of the sleeve under pressure conditions in which the fluid pressure in the annulus between the drill string and the well casing is greater than the pressure inside the sleeve 30. Such a situation, without the presence of the shoulder or ledge 68, would normally result in the fluid pressure exerted on the lower surface of the shoulder or ledge being translated into upward movement of the sleeve.

Figure 4:
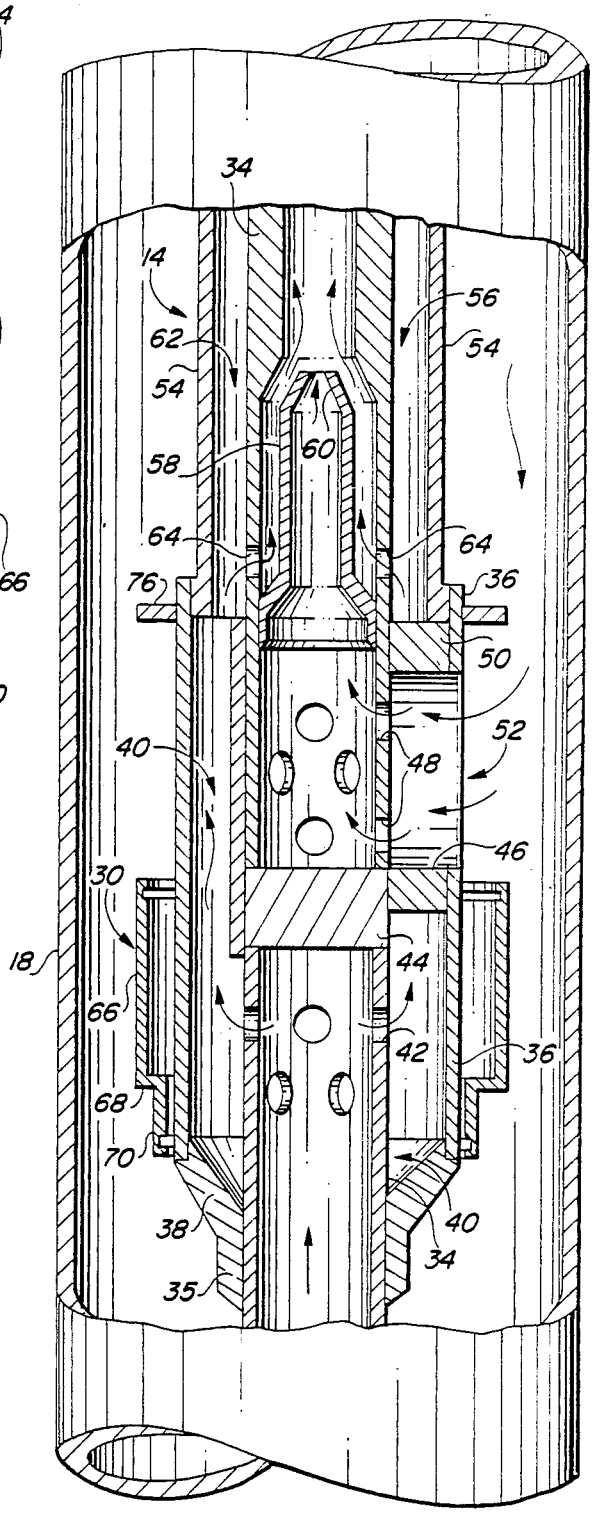
FIG. 4 is a view similar to that of FIG. 2, but showing the openings after they have been uncovered.

Referring to FIG. 4, which shows the same structure as FIG. 2 but with the sleeve moved down from its initial position, treatment fluid is then pumped down the annulus between the drill string 14 and the casing 18. As shown by the flow arrows in FIG. 4, the treatment fluid enters the drill string through the fluid crossover 52 and the openings 48 and, taking the path of least resistance, flows up through the drill string. This causes it to flow through the venturi nozzle 60 of the jet pump which increases the velocity of the fluid to the point where the rapid flow of treatment fluid upwardly through the drill string creates a circulation pattern which draws the formation fluid with it, thereby lifting the formation fluid to the surface. The formation fluid follows the flow path shown by the arrows, traveling up the annulus 40, through the openings 64, up the annulus 62 and into the upper portion of the tube 34. The fluid would continue to flow up to the surface. The nozzle arrangement and related structure enabling the flow pattern just described to take place is known in the art as a reverse flow jet pump.

Note that the seals 72 and 74 of the sleeve construction shown in FIG. 2 are not present in FIG. 4. This is because the seals would become dislodged upon downward movement of the sleeve. Although for purposes of illustration the sleeve is shown in the location indicated in FIG. 4, it will be understood that the sleeve will not necessarily be in that position but may drop to a location not visible in FIG. 4.

It will be understood that FIGS. 2 and 4 are simplified views which do not attempt to show the details of how the nozzle and the various tube sections, connectors, seals and the like are arranged and held in place in the drill string. It will be well understood by those skilled in the art, however, that there are various ways of accomplishing this, any of which may be utilized to enable the venturi action of the jet pump to satisfactorily take place. Further detailed information on jet pumps and their design may be obtained from any of the manufacturers of such equipment. Such pumps are available commercially, for example, from National-Oilwell Corporation, as well as from Kobe Hydraulic Pumps, a Division of Trico Industries Inc.

Although not illustrated in the drawings, a direct flow jet pump can be employed instead of a reverse flow jet pump. In such an arrangement the venturi nozzle is reversed so that treatment fluid is pumped down the drill string instead of down the annulus between the drill string and the well casing. The treatment fluid will have its flow rate increased by the nozzle and will then flow out the crossover and up the annulus to the surface. As in the operation described above, the increased flow rate of the treatment fluid causes a circulation pattern which draws the formation fluid up the drill string, blends the formation fluid with the rapidly moving treatment fluid and causes the blended stream to flow through the crossover and up the annulus to the surface.

As mentioned above, the standing valve 28, by preventing downward flow, permits fluid introduced into the sleeve to be maintained under sufficient pressure to move the sleeve down from its initial position covering the fluid crossover and also prevents downward flow of the treatment fluid. Thus when the drill stem test has ended and the pumping of treatment fluid has ceased, the standing valve acts to isolate the bottom of the well, thereby producing a down hole shut-in condition and allowing a down hole shut-in pressure test to proceed. Since this can take place on the same trip of the drill string as was used for the drill stem test, substantial savings are realized.

It can now be appreciated that the present invention provides a simple, economical, yet highly effective way of lifting to the surface formation fluid which is not under sufficient reservoir or solution gas pressure to flow to the surface naturally. The ability to include the jet pump in the drill string on the initial trip of the drill string into the bore obviates the need to send the drill string down on multiple trips or to use a wire line in order to carry out a drill stem test. Although methods of uncovering the openings leading to the jet pump nozzle other than by the sleeve valve described herein may be designed and employed, it has been found that the sleeve valve functions reliably and efficiently, is economical, and is thus the preferred valve to use. Because of the ability of the jet pump to function in either the reverse or direct mode, treatment fluid may be pumped down either the annulus or the drill string as preferred.

It should now be understood, after reading the foregoing description, that the invention is not necessarily limited to all the specific details described in connection with the preferred embodiment, but that changes to certain features of the preferred embodiment which do not affect the overall basic function and concept of the invention may be made by those skilled in the art without departing from the spirit and scope of the invention, as defined in the appended claims.

What is claimed is:

1. A method of causing formation fluid to flow upwardly during a drill stem test of a fluid well, comprising the steps of:

inserting a drill string into a fluid well bore, the drill string containing a fluid jet pump having a covered fluid crossover;

sealing the well bore in the area of the bottom portion of the drill string;

creating openings in the side wall of the well bore below the well bore seal to permit fluid from the surrounding formation to flow therethrough;

the drill string having a first opening below the well bore seal through which formation fluid can flow;

uncovering the fluid crossover in response to fluid pressure within the drill string to create a second opening in the drill string at a location above the well bore seal; and causing treatment fluid to flow through the second opening and into the fluid jet pump to allow the fluid jet pump to lift the formation fluid.

2. A method according to claim 1, wherein the treatment fluid is introduced under pressure into the annulus between the drill string and the well bore, the treatment fluid flowing through the second opening and up the interior of the drill string.

3. A method according to claim 1, wherein the treatment fluid introduced under pressure into the interior of the drill string, the treatment fluid flowing out the second opening and up the annulus between the drill string and the well bore.

4. A method according to claim 1, including the step of providing standing valve means in the drill string between the first and second openings.

5. A method according to claim 1, wherein the step of uncovering the fluid crossover comprises moving a sleeve which initially covers the crossover to a location which uncovers the crossover, the sleeve being movable in the direction of the length of the drill string and having an interior transverse surface exposed to fluid pressure from within the drill string, said surface permitting fluid pressure within the drill string to move the sleeve.

6. Apparatus for causing formation fluid to flow upwardly during a drill stem test of a fluid well, comprising:

a drill string positioned in the bore of the fluid well and seated with a packer seal;

the drill string containing a first opening below the packer through which formation fluid can flow into the drill string;

means for creating a second opening in the drill string above the packer through which treatment fluid can flow; and jet pump means including a fluid crossover, the jet pump means being mounted within the drill string for increasing the rate of flow of the treatment fluid near the second opening a substantial amount such that the upward flow of the treatment fluid draws the formation fluid upwardly therewith, the means for creating the second opening including a sleeve initially surrounding and covering the fluid crossover, and means for moving the sleeve in response to fluid pressure from within the drill string to uncover the second opening.

7. Apparatus according to claim 6, wherein the sleeve includes an interior surface extending generally transversely of the length of the drill stem, the generally transverse surface being exposed to fluid flowing under pressure down the interior of the drill string and through the second opening, the sleeve being slidably movable when the force of the fluid on the transverse surface exceeds a predetermined amount.

8. Apparatus according to claim 7, including stop means for preventing slidable movement of the sleeve when fluid pressure in the annulus between the drill string and the side wall of the bore is sufficient to slidably move the sleeve in a direction opposite to the direction in which the sleeve moves when uncovering the second opening.

9. Apparatus according to claim 6, including standing valve means in the drill string between the first and second openings.

* * * * *